US006575223B1

(12) United States Patent
Chung et al.

(10) Patent No.: US 6,575,223 B1
(45) Date of Patent: Jun. 10, 2003

(54) CONCEALED TYPE LIFTING CONTROL MECHANISM FOR VENETIAN BLIND

(75) Inventors: Yung-Chen Chung, Kaohsiung (TW); Ya-Wei Hsu, Hsin Chu (TW); Chin Cheng Chen, Hsin Chu (TW)

(73) Assignees: Industrial Technology Research Institute, Hsinchu Hsien (TW); Nien Made Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 10/058,011

(22) Filed: Jan. 29, 2002

(51) Int. Cl.[7] ..... E06B 9/30
(52) U.S. Cl. ..... 160/170 R; 242/378.4
(58) Field of Search ..... 160/170 R, 168.1 R, 160/178.1 R, 279, 192, 84.02, 84.04, 173 R; 242/378, 378.4, 385.4

(56) References Cited

U.S. PATENT DOCUMENTS 794,937 A * 7/1905 Hopkins
800,279 A * 9/1905 Emery
2,798,680 A * 7/1957 Farrington et al.
3,397,849 A * 8/1968 Hansen
4,470,556 A * 9/1984 Matsuoka
5,105,867 A * 4/1992 Coslett
5,170,830 A * 12/1992 Coslett
5,294,029 A * 3/1994 Shimura et al.
5,482,100 A * 1/1996 Kuhar
5,531,257 A * 7/1996 Kuhar
5,996,667 A * 12/1999 Fun
6,024,154 A * 2/2000 Wang et al.
6,029,734 A * 2/2000 Wang et al.
6,289,965 B1 * 9/2001 Ruggles
6,330,899 B1 * 12/2001 Ciuca et al.
6,378,797 B1 * 4/2002 Liao

* cited by examiner

*Primary Examiner*—Blair M. Johnson
(74) *Attorney, Agent, or Firm*—Browdy and Neimark

(57) ABSTRACT

A concealed type lifting control mechanism installed in a Venetian blind and adapted to control lifting of the lift cord of the Venetian blind comprises at least two take-up reel sets that provide a predetermined spring release force and are connected to the lift cord to impart a roll-up prestress to the lift cords for taking up the lift cords, a synchronizing transmission unit coupled to the at least two take-up reel sets for enabling the at least two take-up reel sets to be work synchronously, and a positioning device set provided between the take-up reel sets and moved between an engagement position and a release position to determine the provision of the roll-up prestress, for enabling the lift cords to be moved to adjust the Venetian blind to the desired elevation.

11 Claims, 5 Drawing Sheets

CONCEALED TYPE LIFTING CONTROL MECHANISM FOR VENETIAN BLIND

FIELD OF THE INVENTION

The present invention relates to Venetian blinds and, more specifically, to a concealed type lifting control mechanism for Venetian blind, which keeps the ends of the lift cords of the Venetian blind from sight.

BACKGROUND OF THE INVENTION

A window may be provided with a Venetian blind that can be opened or closed to regulate the light, air, etc. A regular Venetian blind comprises headrail, a blind formed of a set of slats and a bottom rail and suspended from the headrail, a lifting control mechanism adapted for controlling the lifting of the blind, and a tilt control mechanism adapted for tilting the slats to regulate the light.

The lifting control mechanism comprises an external lift cord, a slat lift cord, and a lift lock. The external lift cord is suspended from the headrail of the Venetian blind at one lateral side of the slats for pulling by hand. The slat lift cord is inserted through the slats and connected between the bottom rail of the blind and one end of the external lift cord. The user can pull the external lift cord to move the slat lift cord, and to further control the elevation of the blind. Pulling the external lift cord can simultaneously move the lift lock between the locking position and the unlocking position. Therefore, the user can adjust the blind to the desired elevation by means of operating the external lift cord. Because the external lift cord is suspended from the headrail of the blind at one side of the slats, it is conveniently accessible. However, because the external lift cord is not kept out of reach of children, children may pull the external lift cord for fun. In case the external lift cord is hung on a child's head, a fetal accident may occur. Furthermore, the external lift cord tends to be tangled with the tilt cord of the tilt control mechanism or the slats of the blind.

Taiwan Patent No. 149396 (application no. 8722193) discloses a Venetian blind lifting control mechanism, which uses a winding spring to automatically take up the external lift cord after each operation. When stopped at a particular elevation, the return force of the spring, the weight of the blind, and the friction force between the lift cord and the related elements are maintained in balance, keeping the blind positioned in the desired elevation. However, because the friction force and the spring, force vary with the wear extent of the related elements after a long use of the Venetian blind, the ends of the slats cannot be maintained in balance during elevation adjustment of the blind.

SUMMARY OF THE INVENTION

The present invention has been accomplished to provide a concealed type lifting control mechanism for Venetian blind, which is safe in use and, keeps the ends of the slats of the blind in balance during elevation adjustment of the blind.

To achieve the object of the present invention, the concealed type lifting control mechanism comprises at least two take-up reel sets, a synchronizing transmission unit and a positioning device set. Each of the two take-up reel sets comprises a lift cord take-up unit, and a spring release unit, said spring release unit providing a predetermined springy release force and linked to said lift cord take-up unit, said lift cord take-up unit being fixedly connected to the lift cords of the Venetian blind to impart a roll-up prestress to the lift cords of the Venetian blind for taking up the lift cords. The synchronizing transmission unit is coupled to the lift cord take-up units of said at least two take-up reel sets, for enabling the lift cord take-up units to be moved synchronously. The positioning device set comprises a retaining member provided between said take-up reel sets and moved between an engagement position where said retaining member engages said take-up reel sets to offset said roll-up prestress and to keep the lift cords of the Venetian blind in position, and a release position where said retaining member is disengaged from said take-up reel sets to let the lift cords of the Venetian blind being adjusted to the desired elevation.

DETAILED DESCRIPTION OF THE INVENTION

Referring to FIGS. from 1 through 3, a concealed type lifting control mechanism 10 is installed in a Venetian blind 20 for lifting control.

Figure 2:
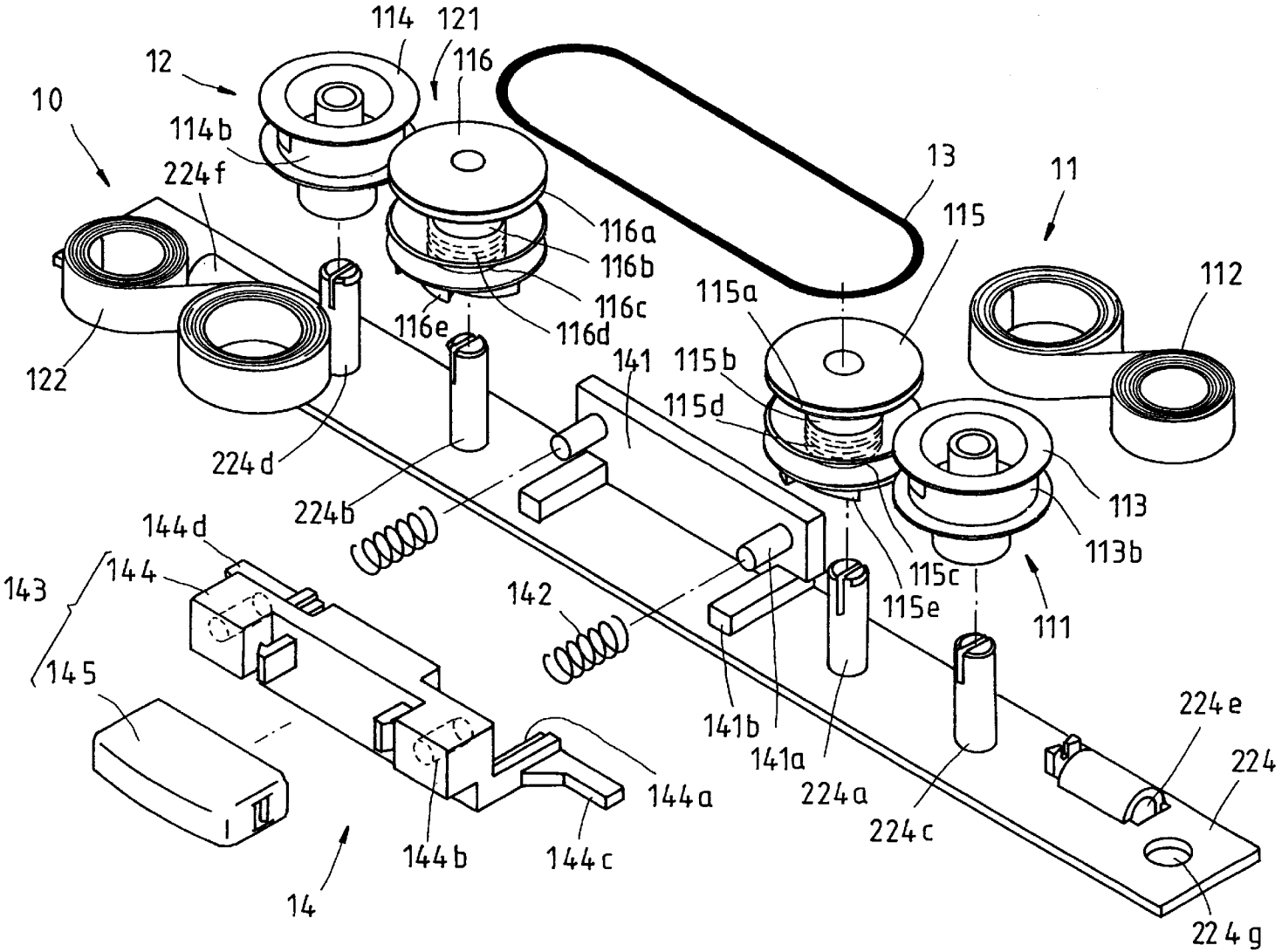
FIG. 2 is an exploded view of the lifting control mechanism according to the preferred embodiment of the present invention.
Figure 3:
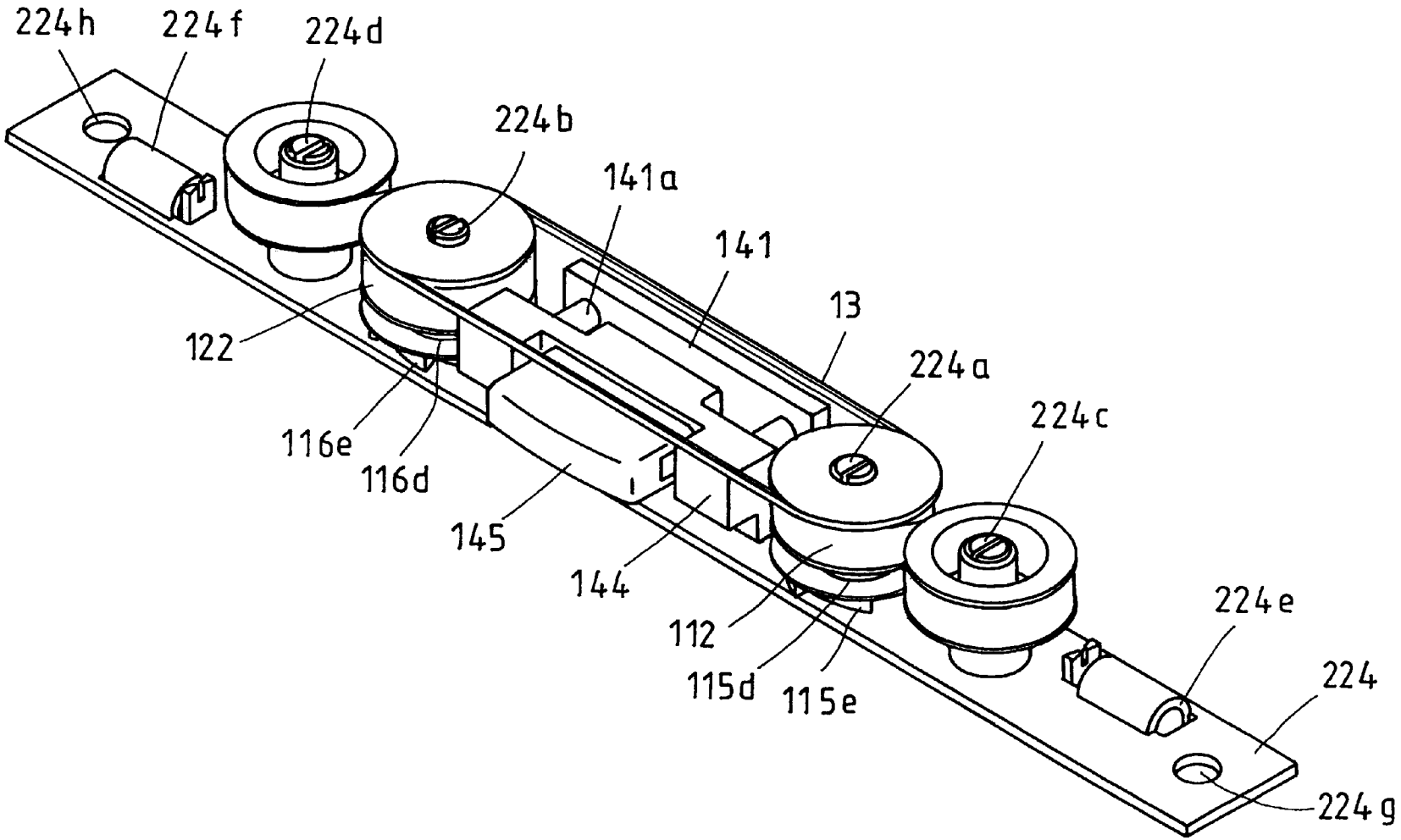
FIG. 3 is an assembly view of the lifting control mechanism according to the preferred embodiment of the present invention.

The Venetian blind 20 comprises a headrail 21, a blind 22, a lift cord unit 23, and a tilt rod unit 24. The headrail 21 is adapted for fastening to the topside of a window, having a mounting portion 21*a* and 21*b* at each of the two distal ends thereof. The blind 22 comprises a number of slats 221 and a bottom rail 222. Each slat 221 has, through holes 223 corresponding to each of the mounting portions 21*a* and 21*b* of the headrail 21. The bottom rail 222 comprises a bottom plate 224 and a cover plate 225. As shown in FIGS. 2 and 3, the bottom plate 224 comprises a predetermined number of upright rods 224*a*, 224*b*, 224*c* and 224*d*, two locating holes 224*e* and 224*f*, and two through holes 224*g* and 224*f*. The cover plate 225 covers the bottom plate 224, defining with the bottom plate 224 a receiving chamber (not shown).

As shown in FIG. 3, the lift cord unit 23 comprises two lift cords 23*a* and 23*b* each having a first end respectively fixedly connected to the mounting portions 21*a* and 21*b* of the headrail 21 and a second end respectively inserted in proper order through the through holes 223 of the slats 22 and the locating holes 224*e* and 224*f* of the bottom plate 224.

Figure 1:
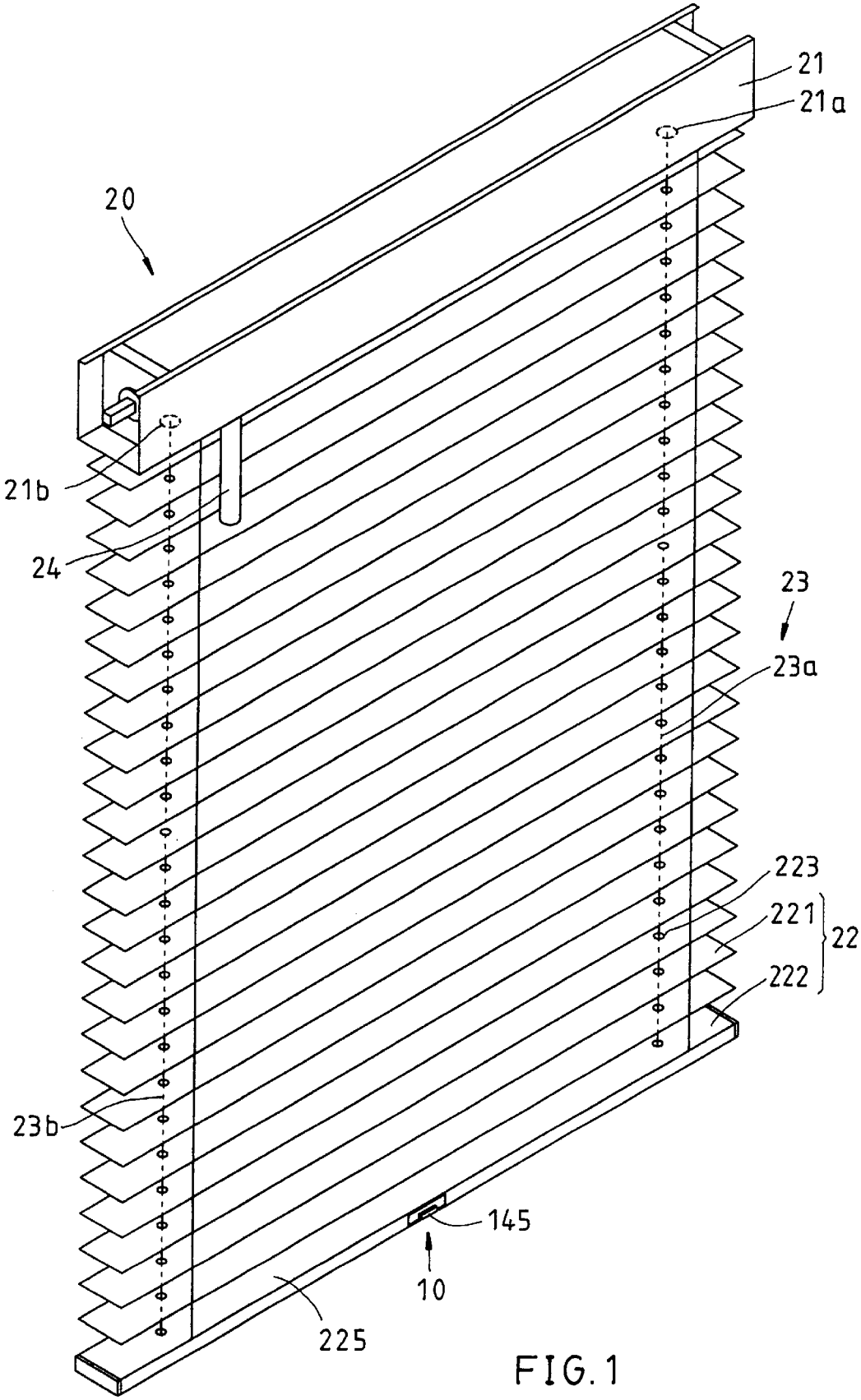
FIG. 1 is a perspective view of a preferred embodiment of the present invention showing the lifting control mechanism installed in a Venetian blind.

As shown in FIG. 1, the tilt rod unit 24 couples the blind 22 to the headrail 21 and adapted to control the tilting angle of the blind 22, determining the amount of light passing through the gaps between the slats 221.

Because the Venetian blind 20 is of the known art, no further detailed description is necessary.

Further, the lifting control mechanism 10 comprises at least two take-up reel sets 11 and 12, a synchronizing transmission unit 13, and a positioning device set 14.

Figure 4:
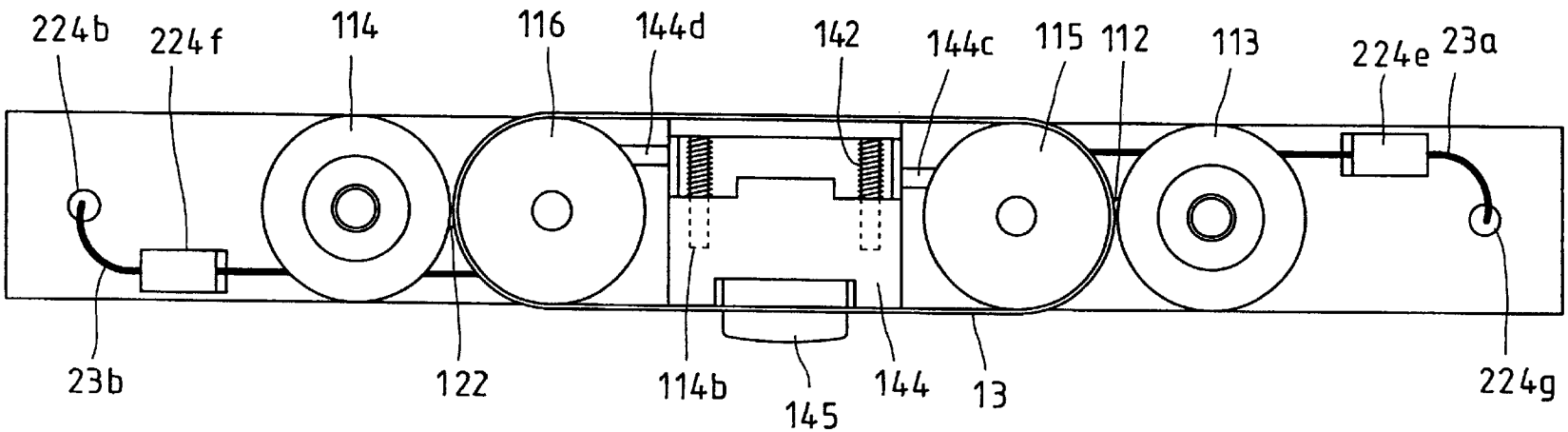
FIG. 4 is a top view of the preferred embodiment of the present invention.

The take-up reel sets 11,12 each comprise a lift cord take-up unit 111 or 121, and a spring release unit 112 or 122. The lift cord take-up unit 111 or 121 comprises a spring reel 113 or 114, and a cord reel 115 or 116. The spring reels 113,114 are hollow reels respectively sleeved onto upright rods 224*c*, 224*d* of the bottom plate 224, each having a recessed middle section of predetermined depth and width that forms a mounting groove 113*b* or 114*b*. The cord reels 115,116 are hollow reels respectively sleeved onto the other upright rods 224*a*,223*b* of the bottom plate 224 between the spring reels 113,114, each comprising a transmission coupling groove 115*a* or 116*a* disposed at the top, a spring mounting groove 115*b* or 116*b* disposed around the periphery on the middle corresponding to the mounting grooves 113*b*,114*b* of the spring reels 113,114, a lift cord mounting groove 115*c* or 116*c* disposed around the periphery at the bottom side, raised lines 115*d* or 116*d* disposed in the lift cord mounting groove 115*c* or 116*c* to facilitate winding of the lift cord, and ratchet-like bottom first stopping portions 115*e* or 116*e* outside the lift cord mounting groove 115*c* or 116*c* (see FIG. 3). After inserted through the locating holes 224*e*,224*f* of the bottom plate 224, the second ends of the lift cords 23*a*,23*b* of the lift cord unit 23 are respectively coupled to the lift cord mounting grooves 115*c*,116*c* of the cord reels 115,116 (see FIG. 4).

Referring to FIGS. 2 and 3 again, the spring release units 112,122 can be, for example, springs of constant torque, spiral springs, or the like that provide a springy release force. The spring release units 112,122 are respectively mounted in the lift cord take-up units 111,121, imparting a roll-up prestress to the lift cord take-up units 111,121. According to the present preferred embodiment, the spring release units 112,122 are springs of constant torque, each having two ends respectively wound round the mounting grooves 113*b*,114*b* of the spring reels 113,114 and the mounting grooves 115*b*,116*b* of the cord reels 115,116 to produce a roll-up prestress between the spring reels 113,114 and the cord reels 115,116.

The synchronizing transmission unit 13 can be a belt, idle pulley, worm, or the like that drives the take-up reel sets 11,12 to rotate at the same time. According to the present preferred embodiment, the synchronizing transmission unit 13 is a transmission belt mounted on the transmission coupling grooves 115*a*,116*a* of the cord reels 115,116 at a high tension status for enabling the cord reels 115,116 to be rotated synchronously. Because the synchronizing transmission unit 13 is a transmission belt mounted on the transmission coupling grooves 115*a*,116*a* of the cord reels 115,116 at a high tension status, it does not fall from the cord reels 115,116 during rotation of the cord reels 115,116 (See FIGS. 2 and 3).

The positioning device set 14 is provided between the take-up reel sets 11,12, comprising a locating member 141, two springs 142, and an actuating unit 143. The locating member 141 is provided at one side of the bottom plate 224 of the blind 22 between the cord reels 115,116 of the take-up reel sets 11,12, comprising two stop rods 141*a* and two stop blocks 141*b*. The springs 142 are respectively mounted on the stop rods 141*a* of the locating member 141. The actuating unit 143 comprises a retaining member 144, and an actuating member 145 coupled to the retaining member 144. The retaining member 144 comprises a recessed slot 144*a*, which receives the stop blocks 141*b*, two locating holes 144*b*, which receives the stop rods 141 a respectively, and two retaining portions 144*c*,144*d* respectively outwardly disposed at two sides and adapted to engage the ratchet-like bottom stopping portions 115*e*, 116*e* of the take-up reel sets 11,12 alternatively and to further control the take-up action of the lift cords 23*a*,23*b*. The width of the recessed slot 144*a* is approximately equal to or slightly greater than the width of the stop blocks 141*b*. The diameter of the locating holes 144*b* is slightly greater than the diameter of the stop rods 141*a*, but smaller than the outer diameter of the springs 142, so that the recessed slot 144*a* can be moved with the retaining member 144 along the stop blocks 141*b* between the engagement position and the relief position.

Referring to FIGS. 1 and 3 again, the cover plate 225 is covered on the bottom plate 224, keeping a part of the actuating member 145 extended to the outside of the cover plate 225 for operation.

The operation of the present invention is outlined hereinafter with reference to FIGS. from 4 through 6.

Figure 5:
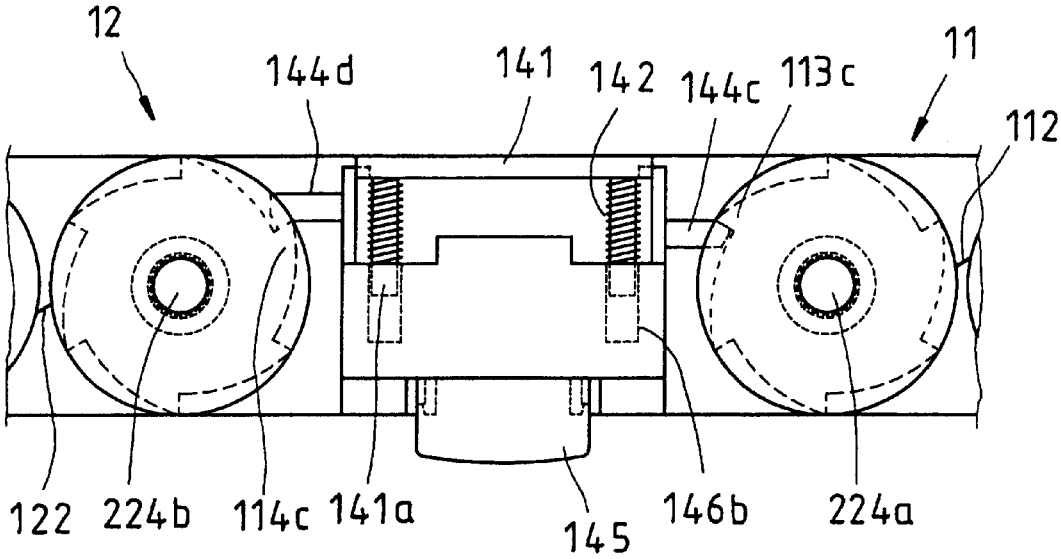
FIG. 5 is a schematic drawing showing the actuating unit of the lifting control mechanism moved to the engagement position according to the preferred embodiment of the present invention.

As shown in FIG. 5, when the actuating member 145 of the lifting mechanism 10 receives no force (from the user's hand), the springs 142 forces the retaining member 144 to the engagement position to stop the lift cords from movement, and therefore the blind of the Venetian blind is stopped at the desired elevation, i.e., the retaining portions 144*c*,144*d* of the retaining member 144 are moved with the retaining member 144 to the path of the ratchet-like bottom stopping portions 115*e*,116*e* of the take-up reel sets 11,12 to engage the bottom stopping portions 115*e*,116*e* and to offset the release prestress applied by the spring release units 112,122 to the lift cord take-up units 111,121, stopping the lift cord take-up units 111,121 from rotation, and therefore the lift cords 23*a*,23*b* are stopped from lifting the blind 22.

Figure 6:
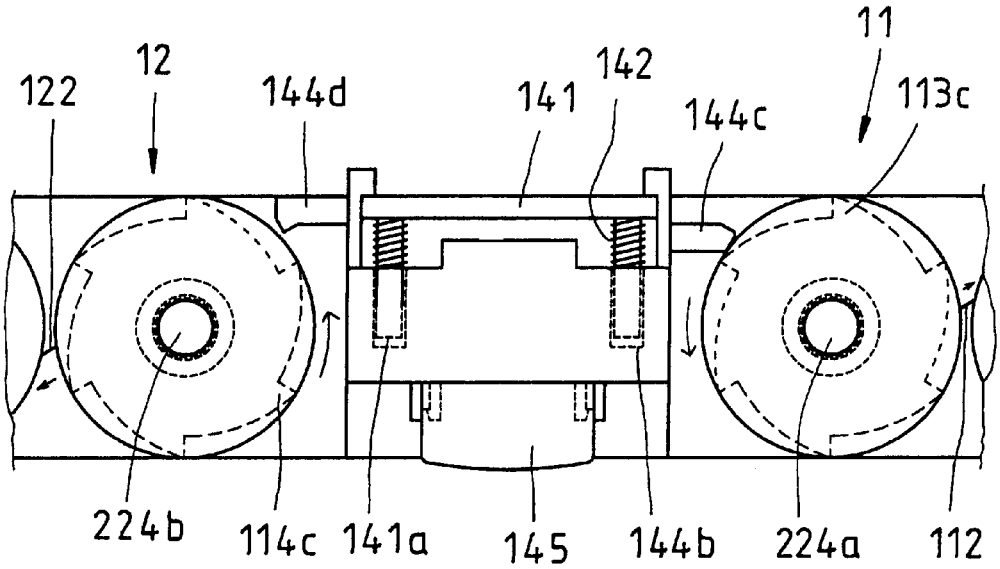
FIG. 6 is a schematic drawing showing the actuating unit of the lifting control mechanism moved to the release position according to the present invention.

Referring to FIG. 6, when the actuating member 145 of the lifting mechanism 10 received an external force (from the user's hand) greater than the spring power of the springs 142, the retaining member 144 is moved from the engagement position to the release position to release the take-up reel sets 11,12, enabling the take-up reel sets 11,12 to impart a take-up prestress to the lift cords 23*a*,23*b*. At this time, the user can push or pull the bottom rail 22 to adjust the elevation of the blind 22. In other words, the release position is to move the retaining portions 144*c*,144*d* of the retaining member 144 away from the path of the ratchet-like bottom stopping portions 115*e*,116*e* of the take-up reel sets 11,12, for enabling the spring release units 112,122 to rotate the cord reels 115,116. At this time, the user can push the blind 22 upwards or pull the blind 22 downwards to the desired elevation.

When adjusting the elevation of the blind 22, the lift cords 23*a*,23*b* force the cord reels 115,116 to rotate. Because the synchronizing transmission unit (belt) 13 drives the cord reels 115,116 to rotate synchronously, the cord reels 115,116 take up the lift cords 23*a*,23*b* at equal length, preventing sloping of the blind 22 between the ends.

As indicated above, the lifting mechanism of the present invention achieve the following advantages:

1. High Safety

Because the lift cords are disposed in the blind and have no protruding part extended to the outside of the blind, the invention keeps the lift cords out of reach of children, preventing occurrence of accident.

2. Stable Elevation Adjustment

Because a synchronizing transmission unit is coupled between the cord reels, the cord reels are rotated to take up/let off the lift cords synchronously during adjustment, keeping the blind constantly in balance. Therefore, the elevation of the blind is adjusted smoothly stably.

What is claimed is:

1. A concealed type lifting control mechanism installed in a Venetian blind and adapted to control the lifting of the lift cords of the Venetian blind, comprising:

at least two take-up reel sets, said take-up reel sets each comprising a lift cord take-up unit, and a spring release unit, said spring release unit providing a predetermined springy release force and linked to said lift cord take-up unit, said lift cord take-up unit being fixedly connected to the lift cords of the Venetian blind to impart a roll-up prestress to the lift cords of the Venetian blind for taking up the lift cords;

a synchronizing transmission unit embodied as a transmission belt coupled to the lift cord take-up units of said at least two take-up reel sets, for enabling the lift cord take-up units to be moved synchronously; and a positioning device set, said positioning device set comprising a retaining member provided between said take-up reel sets and moved between an engagement position where said retaining member engages said take-up reel sets to offset said roll-up prestress and to keep the lift cords of the Venetian blind in position, and a release position where said retaining member is disengaged from said take-up reel sets to let the lift cords of the Venetian blind to be adjusted to the desired elevation.

2. The concealed type lifting control mechanism as claimed in claim 1, wherein said spring release unit is a spring of constant torque.

3. The concealed type lifting control mechanism as claimed in claim 1, wherein said spring release unit is a spiral spring.

4. The concealed type lifting control mechanism as claimed in claim 1, wherein the lift cord take-up unit of each of said take-up reel sets comprises a spring reel and a cord reel respectively connected to the spring release unit of the respective take-up reel set to provide a roll-up prestress by means of the spring release unit of the respective take-up reel set.

5. The concealed type lifting control mechanism as claimed in claim 4, wherein said spring reel and said cord reel each have a mounting groove coupled to the spring release unit of the respective take-up reel set.

6. The concealed type lifting control mechanism as claimed in claim 1, wherein said lift cord take-up unit comprises a transmission coupling groove coupled to said synchronizing transmission unit.

7. The concealed type lifting control mechanism as claimed in claim 1, wherein the lift cord take-up unit of each of said take-up reel sets comprises a spring reel and a cord reel, said cord reel having a stopping portion, said retaining member of said positioning device set providing at two lateral sides thereof with retaining portion respectively, which is forced into engagement with the stopping portion of the cord reel of the lift cord take-up unit of each of said take-up reel sets when said retaining member is moved to said engagement position.

8. The concealed type lifting control mechanism as claimed in claim 7, wherein the stopping portion of the cord reel of the lift cord take-up unit of each of said take-up reel sets is a ratchet.

9. The concealed type lifting control mechanism as claimed in claim 1, wherein the lift cord take-up unit of each of said take-up reel sets comprises a spring reel and a cord reel, said cord reel comprising a lift cord mounting groove coupled to one lift cord of the Venetian blind, and raised lines disposed in the lift cord mounting groove to facilitate winding of the corresponding lift cord.

10. The concealed type lifting control mechanism as claimed in claim 1, wherein said positioning device set further comprises a locating member having at least one stop rod, and at least one spring respectively mounted on the at least one stop rod of said locating member; said retaining member has at least one recessed hole for receiving said stop rod, wherein said spring of the positioning device is stopped between said locating member and said retaining member to support said retaining member in said engagement position.

11. The concealed type lifting control mechanism as claimed in claim 1, wherein said positioning device set further comprises a locating member, said locating member comprising a recessed slot; said retaining member comprises at least one stop block which is received in the recessed slot of said locating member for enabling said stop block to be moved linearly with said locating member in said recessed slot between said engagement position and said release position.

* * * * *